US006669123B2

(12) United States Patent
Spyra

(10) Patent No.: US 6,669,123 B2
(45) Date of Patent: Dec. 30, 2003

(54) CRUSHING DEVICE

(76) Inventor: Thomas Spyra, Richard-Wagner-Strasse 5, Waiblingen (DE), 71332

( * ) Notice: Subject to any disclaimer, the term of this patent is extended or adjusted under 35 U.S.C. 154(b) by 58 days.

(21) Appl. No.: 09/930,486

(22) Filed: Aug. 16, 2001

(65) Prior Publication Data

US 2002/0027174 A1 Mar. 7, 2002

(30) Foreign Application Priority Data

Aug. 16, 2000 (DE) ..... 100 40 602

(51) Int. Cl.[7] ..... B02C 25/00
(52) U.S. Cl. ..... 241/36; 37/161; 37/257.1
(58) Field of Search ..... 241/36, 37, 39, 241/160, 161, 257.1, 261.1

(56) References Cited

U.S. PATENT DOCUMENTS 1,941,770 A * 1/1934 Welsford et al. ..... 241/37
4,351,485 A * 9/1982 Hardwick et al. ..... 241/36
4,529,134 A * 7/1985 Williams ..... 241/36
4,709,197 A * 11/1987 Goldhammer et al. .. 241/361 X
4,988,045 A * 1/1991 Griesedieck, III et al. .... 241/37 X
5,785,261 A * 7/1998 Lanner ..... 241/36

* cited by examiner

*Primary Examiner*—W. Donald Bray
(74) *Attorney, Agent, or Firm*—Crowell & Moring LLP

(57) ABSTRACT

A crushing device which is suitable, in particular, for chips, including a hopper for filling the chips therein, a tearing arm serving as a coarse breaking mechanism, and a fine breaking mechanism. The fine breaking mechanism has a grinding mechanism with at least one centrally arranged, rotating blade head, which operatively interacts with the stationary teeth arranged around the periphery of the grinding mechanism. The stationary teeth are disposed on at least two support segments, and the two segments are movably arranged in such a way that if a coarse piece enters the crushing device, the segments can be separated from the blade head so that the coarse piece can then be discharged.

5 Claims, 2 Drawing Sheets

CRUSHING DEVICE

BACKGROUND OF THE INVENTION

The invention relates to a crushing device or comminutor for cuttings or chips from machining operations.

Crushing devices of such a kind are known and comprise a coarse breaking mechanism and a fine breaking mechanism. A hopper into which the cuttings can be filled, is arranged above the coarse breaking mechanism. First, the cuttings are torn by means of the coarse breaking mechanism, and then they are broken into short cuttings by the fine breaking mechanism. Afterwards, the short cuttings are discharged via a chute.

It sometimes happens that coarse pieces like, for example, iron pieces or tool parts are introduced into the hopper. Such coarse pieces are grasped by the coarse breaking mechanism and can cause a blockage of the entire apparatus. To remove such coarse pieces, it is necessary to open a window and to take the piece out of the system manually, which requires a considerable machine down-time. Furthermore, it happens occasionally that the fine breaking mechanism has already been damaged by the coarse piece, so that it has to be replaced.

SUMMARY OF THE INVENTION

The object underlying this invention is to improve a chip-crushing device of the kind described above in such a way that any coarse pieces which enter the crusher are detected before damage to the crushing device occurs.

Another object of the invention is to provide a crushing device in which coarse pieces which could damage the crusher are prevented from being caught in the fine breaking mechanism.

It is also an object of the invention to provide a crushing device which can automatically respond to entry of coarse pieces into the device and discharge such coarse pieces before they can jam or block the crusher.

These and other objects have been achieved in accordance with the present invention by providing a crushing device for cuttings, comprising a hopper for filling cuttings into the device, a tearing arm for coarse breaking of the cuttings, and a fine breaking mechanism, wherein the fine breaking mechanism comprises at least one centrally arranged grinding mechanism with a rotating blade head which operatively interacts with stationary teeth disposed peripherally around the grinding mechanism; the stationary teeth are disposed on at least two support segments; and the at least two support segments are movable in such a way that if a coarse piece enters the crushing device, the segments can be separated from the blade head, so that the coarse piece can be discharged from the crushing device.

A significant advantage of the present invention is that in the fine breaking mechanism, which comprises a grinding mechanism that operatively interacts with stationary teeth disposed on at least two support segments, the support segments are movable in such a way that they can be separated from the blade head of the grinding mechanism if any coarse pieces are introduced into the crusher, so that such coarse pieces are discharged from the crusher. It thus becomes unnecessary to provide any additional openings on the hopper for removal of coarse pieces. The coarse pieces can fall downwards into a container provided for them. Any damage to the blade head or grinding mechanism of the fine breaking mechanism is effectively prevented through opening of the stationary tooth supporting segments.

In accordance with one preferred embodiment of the invention, a flap is arranged below or at the side of the blade head onto which the coarse pieces are ejected.

In accordance with another preferred embodiment of the invention, two or more stationary tooth supporting segments are arranged to be movable outwardly in star shape. Thus, the grinding mechanism can be opened entirely, allowing coarse pieces to be ejected or discharged. The stationary tooth supporting segments can be arranged on slidable stages which can be driven either electrically or pneumatically.

It is likewise possible to drive the slidable stages hydraulically or to connect them to the driving motor by means of mechanical link rods. In the latter case, the rods open the grinding mechanism upon reversal of the driving motor.

According to a further exemplified embodiment, a sensor may be provided for sensing coarse pieces within the hopper and generating a control signal so that the stationary tooth bearing segments will open.

Alternatively, it is possible to recognize a coarse piece and then generate the respective control signals by monitoring changes in the torque of the grinding mechanism. It is even possible to detect the presence of a coarse piece by monitoring the load of the motor or the hydraulic drive and generating a corresponding control signal in response to a detected overload condition in order to activate the ejection of the coarse pieces.

These and other features of preferred embodiments of the invention, in addition to being set forth in the claims, are also disclosed in the specification and/or in the drawings, and the individual features each may be implemented in embodiments of the invention either singly or in the form of subcombinations of two or more features and can be applied to other fields of use and may constitute advantageous, separately protectable constructions for which protection is also claimed.

BRIEF DESCRIPTION OF THE DRAWINGS

The invention will be described in further detail hereinafter with reference to illustrative preferred embodiments shown in the accompanying drawings in which.

DETAILED DESCRIPTION OF PREFERRED EMBODIMENTS

Figure 1:
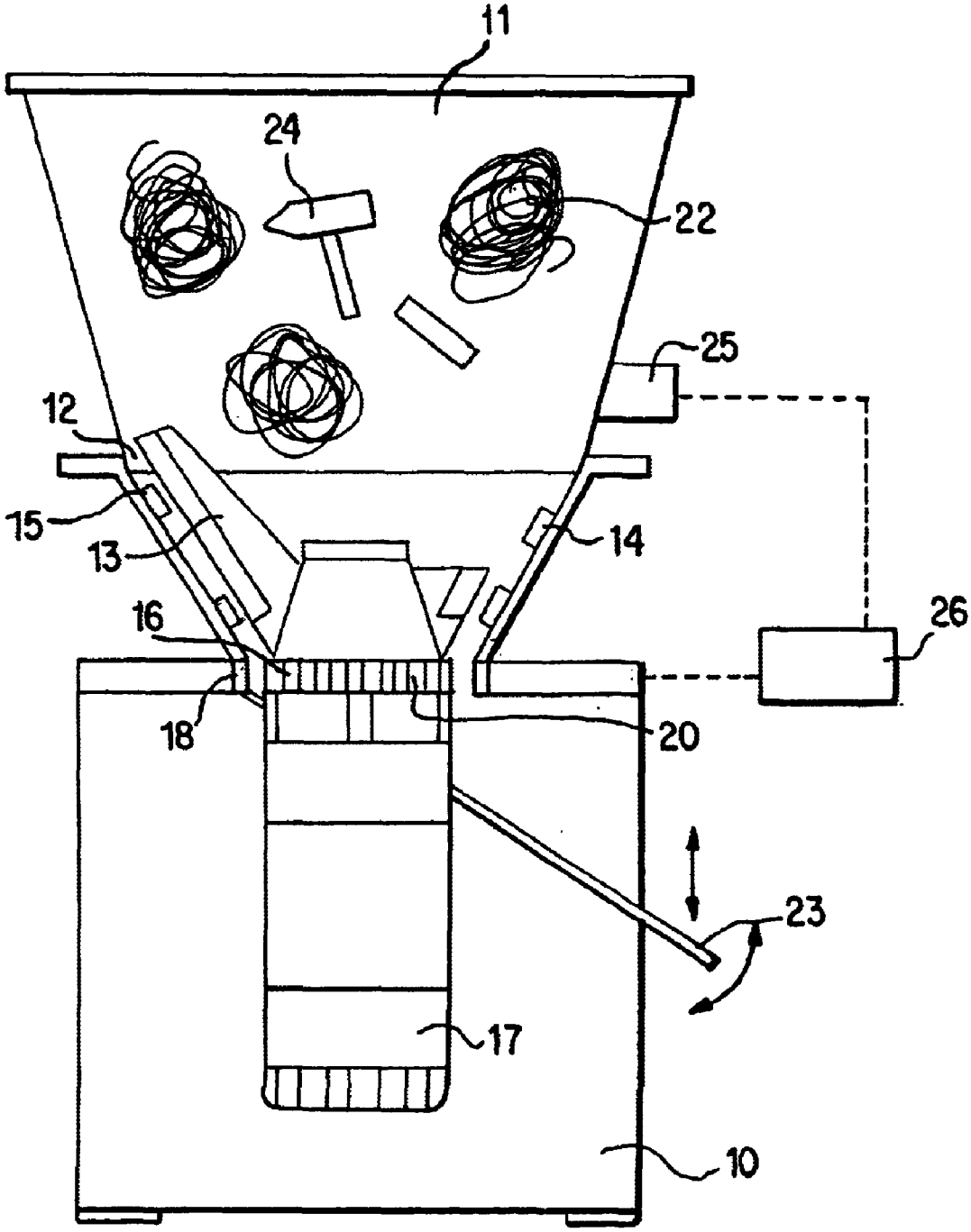
FIG. 1 is a sectional view of a crushing device according to the invention.

The crushing device according to FIG. 1 comprises a frame 10, on which a filling hopper 11 is arranged. Inside the filling hopper 11 there is a coarse breaking mechanism 12, comprised of a tearing arm 13 as well as teeth 14, 15 which are provided on the walls of hopper 11. The tearing arm 13 is driven by motor 17.

A fine breaking mechanism 20 is located below the hopper 11. This fine breaking mechanism comprises a rotating blade head 16 as well as stationary teeth 18 and is likewise driven by motor 17. The cuttings 22 to be crushed, for example metal strands, chips or shavings from machining operations, are introduced into hopper 11. There they are grasped by tearing arm 13 and then reduced in size so that they can be fed to the fine breaking mechanism 20. Beneath the tearing arm 13, the cuttings enter the fine breaking mechanism, where they are processed into short cuttings. After passing through the fine breaking mechanism, the short cuttings are conveyed via a swiveling discharge chute 23 suitable for directing fine chips or coarse chips to a transport container (not shown).

If a coarse piece 24, for example, an iron rod, a steel piece or a tool part, enters hopper 11, it is likewise grasped by tearing arm 13 and teeth 14, 15 or by the fine breaking mechanism. A sensor 25 is provided to generate a control signal to actuate an ejector mechanism if a coarse piece enters the crushing device. The presence of a coarse piece is recognized by the sensor 25, which then emits a detection signal. As a result of this signal, the movable segments which carry the stationary teeth of the fine breaking mechanism will open so that the coarse piece can pass through the fine breaking mechanism and reach the discharge 23 provided for fine chips and coarse chips. A drive unit 26, which may comprise an electrical, hydraulic or pneumatic drive motor, is provided for opening the stationary tooth bearing segments of the fine breaking mechanism.

Alternatively, a control signal for opening the stationary tooth segments of the fine breaking mechanism can be generated in response to an overload condition of the motor determined by monitoring motor torque or the higher current consumption of the motor.

Figure 2:
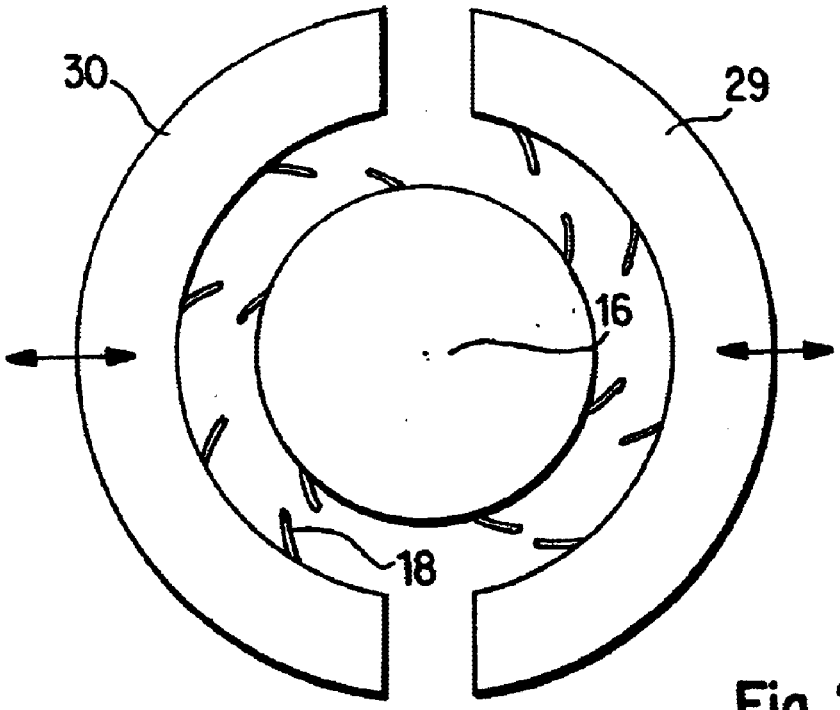
FIG. 2 is a schematic representation of a two-part fine breaking mechanism.

FIG. 2 shows an embodiment of the invention in which the stationary parts of the fine breaking mechanism are divided into two segments 29 and 30. Segments 29, 30 can be moved outwardly apart from one another, thus opening a very large cross-section through the crushing device, so that even larger coarse pieces can pass without hindrance to the discharge provided for fine cuttings and coarse pieces.

Figure 3:
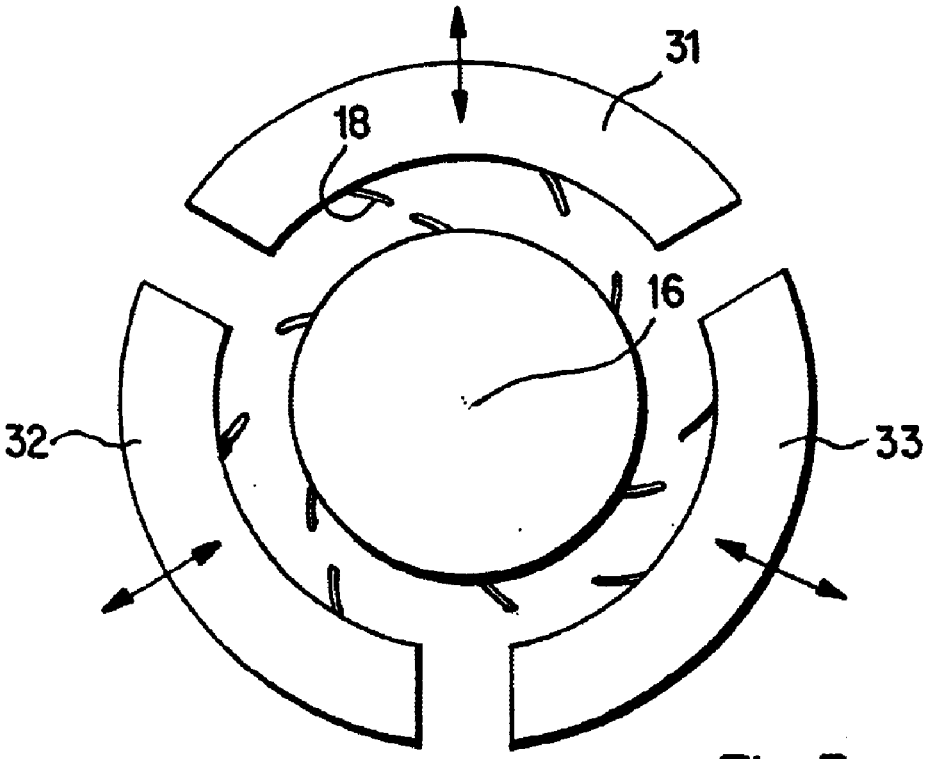
FIG. 3 is a schematic representation of a three-part fine breaking mechanism.

FIG. 3 shows a further embodiment in which the stationary teeth of the fine breaking mechanism are distributed over three toothed segments 31, 32 and 33, which can also be moved outwardly, thus opening a passage for coarse pieces which enter the fine breaking mechanism.

The foregoing description and examples have been set forth merely to illustrate the invention and are not intended to be limiting. Since modifications of the disclosed embodiments incorporating the spirit and substance of the invention may occur to persons skilled in the art, the invention should be construed broadly to include all variations falling within the scope of the appended claims and equivalents thereof.

What is claimed is:

1. A crushing device for cuttings, comprising a hopper for filling cuttings into the device, a tearing arm for coarse breaking of the cuttings, and a fine breaking mechanism, wherein said fine breaking mechanism comprises at least one centrally arranged grinding mechanism having a rotating blade head and stationary teeth disposed peripherally around the rotating blade head;

wherein said stationary teeth are disposed on at least two support segments; and wherein said at least two support segments are movable in such a way that if a coarse piece enters the crushing device, the segments can be separated from the blade head, so that the coarse piece can be discharged from the crushing device.

2. A crushing device according to claim 1, wherein the at least two support segments are arranged to be movable radially outwardly, and wherein such outward movement opens the grinding mechanism to facilitate discharge of any coarse pieces which have entered the crushing device.

3. A crushing device according to claim 1, comprising an electrical, hydraulic or pneumatic drive for moving the support segments to discharge coarse pieces from the crushing device.

4. A crushing device according to claim 1, further comprising a sensor for detecting if a coarse piece has entered the crushing device, said sensor generating a control signal to open the movable support segments on which the stationary teeth are disposed if a coarse piece is detected.

5. A crushing device according to claim 1, wherein entry of a coarse piece is sensed through a changing torque of the grinding mechanism by means of a sensor coupling or an overload protector operatively associated with a drive of the crushing device.

* * * * *